US006612666B1

(12) United States Patent
Berning

(10) Patent No.: US 6,612,666 B1
(45) Date of Patent: Sep. 2, 2003

(54) CRAFT WORK APPARATUS

(76) Inventor: Kathryn B. Berning, 196 Bluff Blvd. #3, Camdenton, MO (US) 65020

( * ) Notice: Subject to any disclaimer, the term of this patent is extended or adjusted under 35 U.S.C. 154(b) by 12 days.

(21) Appl. No.: 09/991,171

(22) Filed: Nov. 16, 2001

(51) Int. Cl.[7] ..... A47B 81/100
(52) U.S. Cl. ..... 312/208.5; 312/194
(58) Field of Search ..... 312/26, 30, 208.5, 312/317.3, 194; 108/93, 102, 50.02, 23

(56) References Cited

U.S. PATENT DOCUMENTS

| | | | | | |
|---|---|---|---|---|---|
| 617,179 | A | * | 1/1899 | Parvin | 108/23 |
| 781,415 | A | * | 1/1905 | Glover | 108/63 |
| 1,100,887 | A | * | 6/1914 | Jasus | 108/93 |
| 2,055,432 | A | * | 9/1936 | Goosman et al. | 112/217.3 |
| 2,899,772 | A | | 8/1959 | Paulsen et al. | |
| 3,600,050 | A | * | 8/1971 | Kunishima | 312/194 |
| 3,745,935 | A | | 7/1973 | Douglas | |
| 3,781,074 | A | * | 12/1973 | Trueblood | 312/30 |
| 3,862,409 | A | * | 1/1975 | Joella et al. | 362/90 |
| 3,870,386 | A | * | 3/1975 | Sheperd | 312/30 |
| 4,548,391 | A | | 10/1985 | Loban | |
| 5,107,775 | A | * | 4/1992 | Langlais et al. | 108/147.21 |
| 5,172,641 | A | | 12/1992 | Auer | |
| 5,386,654 | A | | 2/1995 | Kroenke | |
| D382,730 | S | | 8/1997 | Hsu et al. | |
| 5,939,687 | A | * | 8/1999 | Ellermann | 200/61.58 R |
| 6,092,883 | A | * | 7/2000 | Lechman | 312/194 |
| 6,116,162 | A | * | 9/2000 | Santa Cruz et al. | 108/27 |
| 6,293,506 | B1 | * | 9/2001 | Gutgsell et al. | 248/188.1 |

* cited by examiner

*Primary Examiner*—Janet M. Wilkens

(57) ABSTRACT

A craft work apparatus for designing and working on various different projects. The craft work apparatus includes a table with adjustable legs. An elastomeric mat member is affixed to the top surface of the table. The mat includes a grid. An extension member is attached to an end of the table. A light is releasably attached to the bottom side of the extension member. A plurality of drawers for storage of craft tools and materials is coupled to the bottom surface of the table. A holding member for receiving the foot pedal of a craft tool is pivotally coupled to the bottom surface of the table which allows a person in a wheelchair to activate the pedal with their knee. An ironing board attached to the bottom surface of the table can be slid out from the front edge of the table for use as needed.

17 Claims, 3 Drawing Sheets

CRAFT WORK APPARATUS

BACKGROUND OF THE INVENTION

1. Field of the Invention

The present invention relates to work stations and more particularly pertains to a new craft work apparatus for providing a craftsperson a multipurpose apparatus to utilize when designing and working on various different projects.

2. Description of the Prior Art

The use of work stations is known in the prior art. U.S. Pat. No. 5,172,641 describes a table with a movable working surface. Another type of work station is U.S. Pat. No. 4,548,391 consisting of a fiber craft holder designed for use by the blind and other handicapped persons.

While these devices fulfill their respective, particular objectives and requirements, the need remains for a device that includes a variety of different features that provides a person, especially in the craft area of sewing, an efficient array of features for working on projects.

SUMMARY OF THE INVENTION

The present invention meets the needs presented above by means of the utilization of a specially-designed table having a variety of work areas, along with drawers for storage of the necessary items for the crafts.

Still yet another object of the present invention is to provide a new craft work apparatus that allow a person in a wheelchair to activate the foot pedal of a sewing machine with their knee.

Even still another object of the present invention is to provide a new craft work apparatus that includes a work light for use with a standard pattern drafting stand.

To this end, the present invention generally comprises a table with adjustable legs for adapting to a user's specific needs. An elastomerically compressible mat member is affixed to the top surface of the table for cutting needs. The mat includes a grid for assisting in pattern designs and the like.

An extension member for increasing the area of the top surface is attached to an end of the table. A light is releasably attached to the bottom side of the extension member for use in conjunction with a miniature drafting stand when positioned on the top surface of the table.

A plurality of drawers for storage of craft tools and materials is coupled to the bottom surface of the table.

A holding member for receiving the foot pedal of a craft tool is pivotally coupled to the bottom surface of the table which allows a person in a wheelchair to activate the pedal with their knee.

An ironing board attached to the bottom surface of the table can be slid out from the front edge of the table for use as needed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
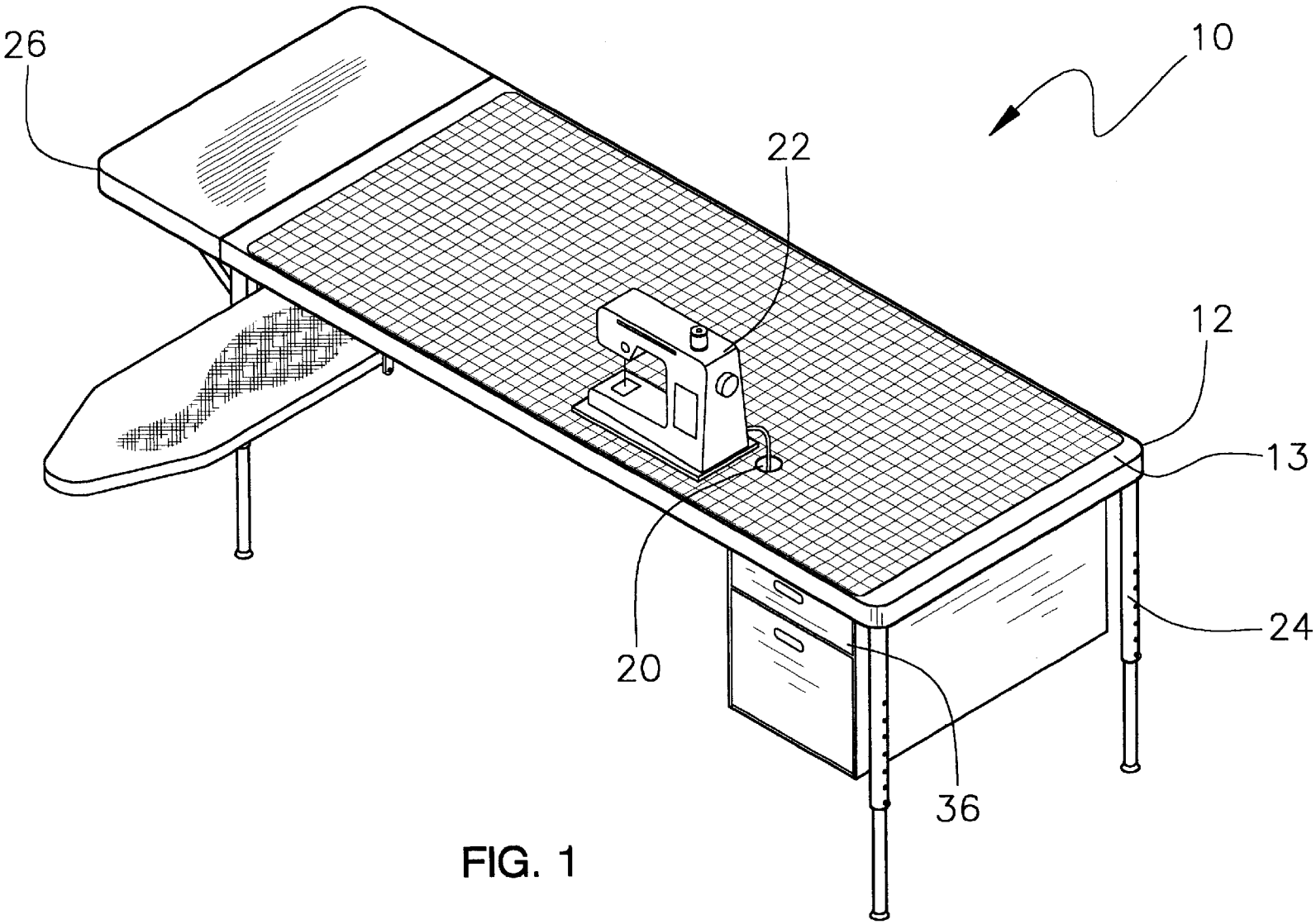
FIG. 1 is a schematic perspective view of a new craft work apparatus according to the present invention.
Figure 2:
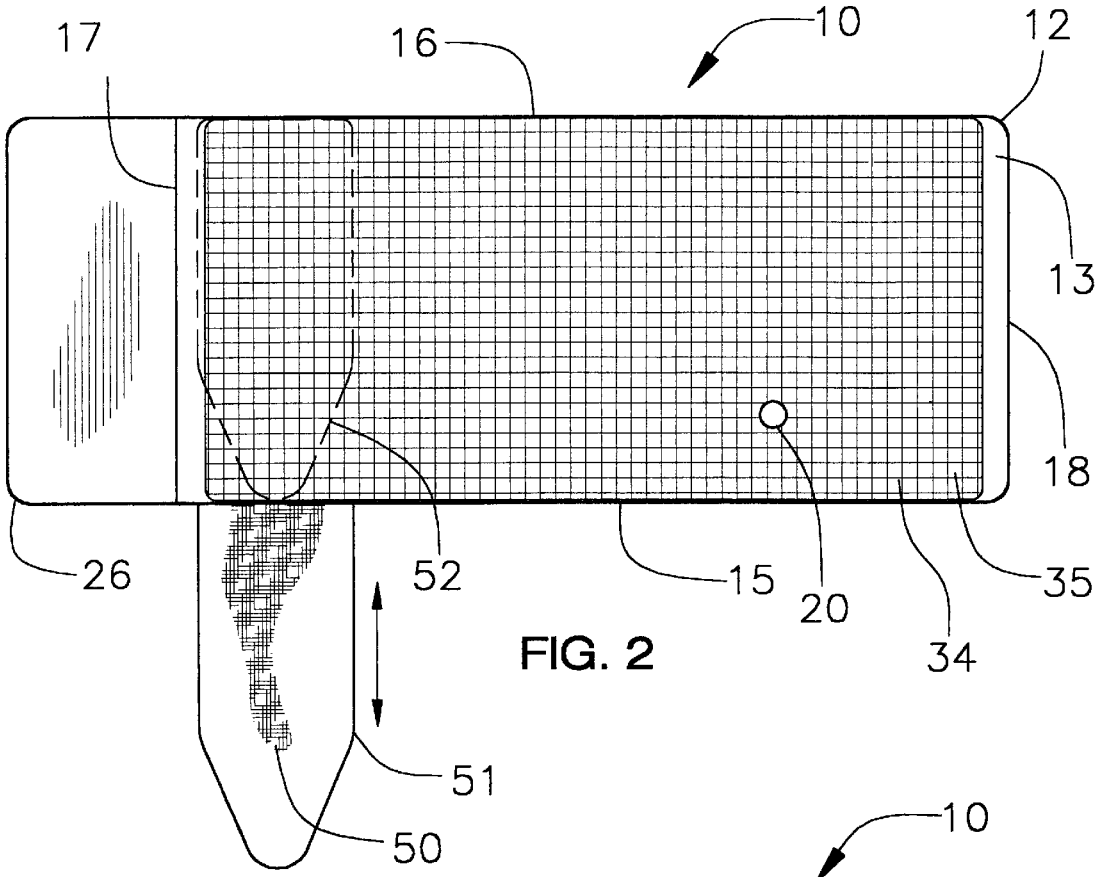
FIG. 2 is a schematic top view of the present invention.
Figure 3:
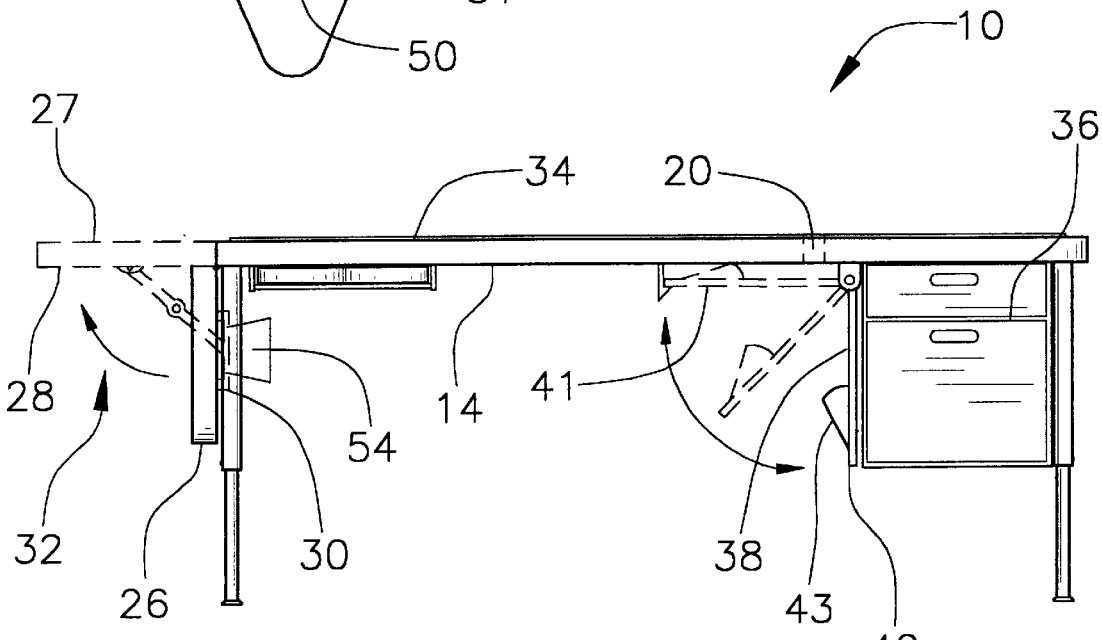
FIG. 3 is a schematic front view of the present invention.
Figure 4:
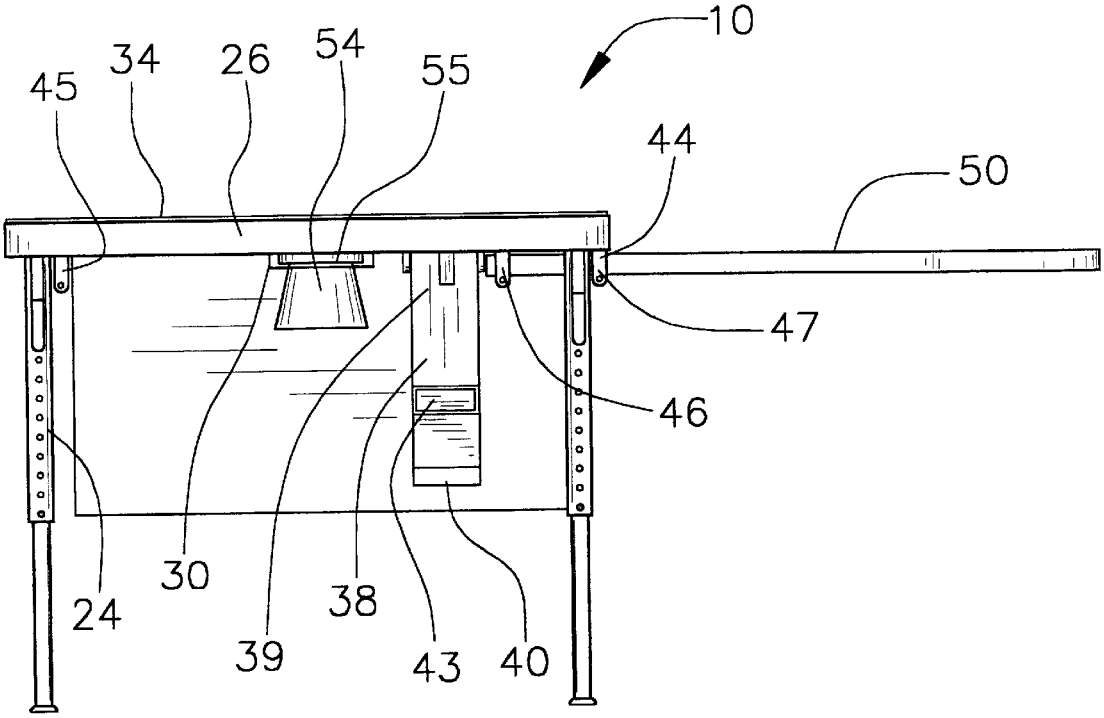
FIG. 4 is a schematic end view of the present invention.
Figure 5:
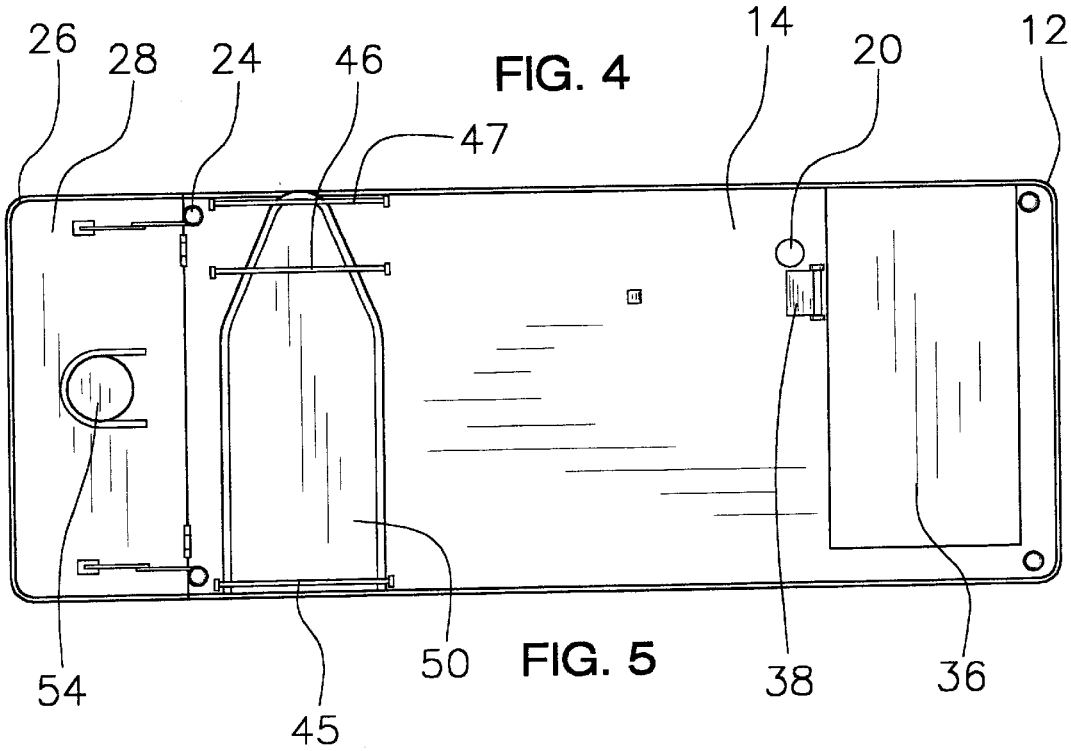
FIG. 5 is a schematic bottom view of the present invention.

With reference now to the drawings, and in particular to FIGS. 1 through 5 thereof, a new craft work apparatus embodying the principles and concepts of the present invention and generally designated by the reference numeral 10 will be described.

As best illustrated in FIGS. 1 through 5, the craft work apparatus 10 generally comprises a table 12 that has a top surface 13 and bottom surface 14. The surfaces 13, 14 are generally rectangular. The table 12 has a front edge 15, a back edge 16, a first side edge 17, and a second side edge 18.

The table 12 has an aperture 20 therein extending through the top and bottom surfaces 13, 14 for receiving electrical cords from the craft tools 22 placed on the top surface 13.

A plurality of leg members 24 supports the table 12. Each is fixedly coupled to the bottom surface 14 positioned proximate one of four corners of the table 12. The leg members 24 are telescoping such that a height of the table 12 is variable.

An extension member 26 increases an area of the top surface 13 and is pivotally coupled to the first side edge 17. The extension member 26 has a top side 27 and a bottom side 28 and includes a rack member 30 that is fixedly coupled to the bottom side 28. The extension member 26 is selectively lockable in a horizontal position 32, wherein the horizontal position 32 is defined when the top side 27 is substantially flush with the top surface 13.

A mat member 34 for performing cutting operations on is fixedly coupled to the top surface 13. The mat member 34 comprises a resiliently compressible material. The mat member 34 has grid indicia 35 thereon.

A plurality of drawers 36 for storing items is attached to the bottom surface 14 of the table 12 near the second side edge 18.

A holding member 38 for receiving a drive pedal for the craft tools 22 has an upper end 39 and a lower end 40. The upper end 39 is pivotally coupled to the bottom surface 14 and positioned adjacent to the drawers 36 between the drawers 36 and the first side edge 17.

The holding member 38 is pivotable 12 between a stored position 41 and a working position 42. The working position 42 is defined by the holding member 38 being vertically oriented and abutting the drawers 36, wherein the stored position 41 is defined by the holding member 38 abutting the bottom surface 14.

The holding member 38 has a pocket portion 43 for holding the drive pedal such that the drive pedal may be operated by a knee of a user.

The holding member 38 is releasably attachable to the bottom surface 14 when rotated upwardly into the stored position 41.

A plurality of bracket members 44 is attached to the bottom surface 14 of the table 12 near the first side edge 17. A first of the bracket members 46 is positioned adjacent the back edge 16. A second of the bracket members 47 is positioned adjacent the front edge 15. A third of the bracket members 48 is positioned between the first and second bracket members 46, 47 nearer the first bracket member 46.

An ironing board 50 is removably attached to the bracket members 44 and is oriented substantially perpendicular to a longitudinal axis of the table 12.

The ironing board 50 has a length generally equal to the length of the table 12 measured from the front edge 15 to the back edge 16 such that the ironing board 50 may be positioned between an extended configuration 51 outwardly from the front edge 15 and a stored configuration 51 underneath the table 12.

A light member 54 for illuminating the top surface 13 has a base portion 55. The base portion 55 is removably attachable to the rack member 30 of the extension member 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A craft work apparatus for supporting and storing craft tools, said apparatus comprising:

a table having a top surface and bottom surface, said surfaces being generally rectangular, said table having a front edge, a back edge, a first side edge, and a second side edge;

a plurality of leg members for supporting said table each being fixedly coupled to said bottom surface positioned proximate one of four corners of said table;

an extension member for increasing an area of said top surface being pivotally coupled to said first side edge, said extension member having a top side and a bottom side;

a mat member for performing cutting operations on being fixedly coupled to said top surface;

a plurality of drawers for storing items being attached to said bottom surface of said table nearer said second side edge;

a holding member for receiving a drive pedal for the craft tools having an upper end and a lower end, said upper end being pivotally coupled to said bottom surface and positioned adjacent to said drawers between said drawers and said first side edge;

a plurality of bracket members being attached to said bottom surface of said table near said first side edge;

an ironing board being removably attached to said bracket members and being oriented substantially perpendicular to a longitudinal axis of said table;

a light member for illuminating said top surface having a base portion;

said holding member being pivotable between a stored position and a working position; and said holding member being releasably attachable to said bottom surface when rotated upwardly into said stored position.

2. The craft work apparatus as set forth in claim 1, further including said table having an aperture therein extending through said top and bottom surfaces for receiving electrical cords from the craft tools placed on said top surface.

3. The craft work apparatus as set forth in claim 1, wherein said leg members being telescoping such that a height of said table is variable.

4. The craft work apparatus as set forth in claim 1, further comprising said extension member including a rack member being fixedly coupled to said bottom side.

5. The craft work apparatus as set forth in claim 4, wherein said base portion being removably attachable to said rack member of said extension member.

6. The craft work apparatus as set forth in claim 1, further including said extension member being selectively lockable in an extended position, wherein said extended position is defined when said top side is substantially flush with said top surface.

7. The craft work apparatus as set forth in claim 1, wherein said mat member comprising a resiliently compressible material.

8. The craft work apparatus as set forth in claim 1, further including said mat member having grid indicia thereon.

9. The craft work apparatus as set forth in claim 1, wherein said working position is defined by said holding member being vertically oriented and abutting said drawers.

10. The craft work apparatus as set forth in claim 1, wherein said stored position is defined by said holding member abutting said bottom surface.

11. The craft work apparatus as set forth in claim 1, further including said holding member having a pocket portion for holding the drive pedal such that the drive pedal may be operated by a knee of a user.

12. The craft work apparatus as set forth in claim 1, a first of said bracket members being positioned adjacent said back edge, a second of said bracket members being positioned adjacent said front edge, a third of said bracket members being positioned between said first and second bracket members nearer said first bracket member.

13. The craft work apparatus as set forth in claim 1, wherein said ironing board having a length generally equal to the length of said table measured from said front edge to said back edge such that said ironing board may be positioned between an extended configuration outwardly from said front edge and a stored configuration underneath said table.

14. A craft work apparatus for supporting and storing craft tools, said apparatus comprising:

a table having a top surface and bottom surface, said surfaces being generally rectangular, said table having a front edge, a back edge, a first side edge, and a second side edge, said table having an aperture therein extending through said top and bottom surfaces for receiving electrical cords from the craft tools placed on said top surface;

a plurality of leg members for supporting said table each being fixedly coupled to said bottom surface positioned proximate one of four corners of said table, said leg members being telescoping such that a height of said table is variable;

an extension member for increasing an area of said top surface being pivotally coupled to said first side edge, said extension member having a top side and a bottom side, said extension member including a rack member being fixedly coupled to said bottom side, said extension member being selectively lockable in an extended position, wherein said extended position is defined when said top side is substantially flush with said top surface;

a mat member for performing cutting operations on being fixedly coupled to said top surface, said mat member comprising a resiliently compressible material, said mat member having grid indicia thereon;

a plurality of drawers for storing items being attached to said bottom surface of said table nearer said second side edge;

a holding member for receiving a drive pedal for the craft tools having an upper end and a lower end, said upper end being pivotally coupled to said bottom surface and positioned adjacent to said drawers between said drawers and said first side edge, said holding member being pivotable between a stored position and a working position, wherein said working position is defined by said holding member being vertically oriented and abutting said drawers, wherein said stored position is defined by said holding member abutting said bottom surface, said holding member having a pocket portion for holding the drive pedal such that the drive pedal may be operated by a knee of a user, said holding member being releasably attachable to said bottom surface when rotated upwardly into said stored position;

a plurality of bracket members being attached to said bottom surface of said table near said first side edge, a first of said bracket members being positioned adjacent said back edge, a second of said bracket members being positioned adjacent said front edge, a third of said bracket members being positioned between said first and second bracket members nearer said first bracket member;

an ironing board being removably attached to said bracket members and being oriented substantially perpendicular to a longitudinal axis of said table, said ironing board having a length generally equal to the length of said table measured from said front edge to said back edge such that said ironing board may be positioned between an extended configuration outwardly from said front edge and a stored configuration underneath said table;

a light member for illuminating said top surface having a base portion, said base portion being removably attachable to said rack member of said extension member.

15. A craft work apparatus for supporting and storing craft tools, said apparatus comprising:

a table having a top surface and bottom surface, said surfaces being generally rectangular, said table having a front edge, a back edge, a first side edge, and a second side edge;

a plurality of leg members for supporting said table each being fixedly coupled to said bottom surface positioned proximate one of four corners of said table;

an extension member for increasing an area of said top surface being pivotally coupled to said first side edge, said extension member having a top side and a bottom side;

a mat member for performing cutting operations on being fixedly coupled to said top surface;

a plurality of drawers for storing items being attached to said bottom surface of said table nearer said second side edge;

a holding member for receiving a drive pedal for the craft tools having an upper end and a lower end, said upper end being pivotally coupled to said bottom surface and positioned adjacent to said drawers between said drawers and said first side edge;

a plurality of bracket members being attached to said bottom surface of said table near said first side edge;

an ironing board being removably attached to said bracket members and being oriented substantially perpendicular to a longitudinal axis of said table;

a light member for illuminating said top surface having a base portion;

said holding member being pivotable between a stored position and a working position; and said working position being defined by said holding member being vertically oriented and abutting said drawers.

16. A craft work apparatus for supporting and storing craft tools, said apparatus comprising:

a table having a top surface and bottom surface, said surfaces being generally rectangular, said table having a front edge, a back edge, a first side edge, and a second side edge;

a plurality of leg members for supporting said table each being fixedly coupled to said bottom surface positioned proximate one of four corners of said table;

an extension member for increasing an area of said top surface being pivotally coupled to said first side edge, said extension member having a top side and a bottom side;

a mat member for performing cutting operations on being fixedly coupled to said top surface;

a plurality of drawers for storing items being attached to said bottom surface of said table nearer said second side edge;

a holding member for receiving a drive pedal for the craft tools having an upper end and a lower end, said upper end being pivotally coupled to said bottom surface and positioned adjacent to said drawers between said drawers and said first side edge;

a plurality of bracket members being attached to said bottom surface of said table near said first side edge;

an ironing board being removably attached to said bracket members and being oriented substantially perpendicular to a longitudinal axis of said table;

a light member for illuminating said top surface having a base portion;

said holding member being pivotable between a stored position and a working position; and said stored position being defined by said holding member abutting said bottom surface.

17. A craft work apparatus for supporting and storing craft tools, said apparatus comprising:

a table having a top surface and bottom surface, said surfaces being generally rectangular, said table having a front edge, a back edge, a first side edge, and a second side edge;

a plurality of leg members for supporting said table each being fixedly coupled to said bottom surface positioned proximate one of four corners of said table;

an extension member for increasing an area of said top surface being pivotally coupled to said first side edge, said extension member having a top side and a bottom side;

a mat member for performing cutting operations on being fixedly coupled to said top surface;

a plurality of drawers for storing items being attached to said bottom surface of said table nearer said second side edge;

a holding member for receiving a drive pedal for the craft tools having an upper end and a lower end, said upper end being pivotally coupled to said bottom surface and positioned adjacent to said drawers between said drawers and said first side edge;

a plurality of bracket members being attached to said bottom surface of said table near said first side edge;

an ironing board being removably attached to said bracket members and being oriented substantially perpendicular to a longitudinal axis of said table;

a light member for illuminating said top surface having a base portion; and a first of said bracket members being positioned adjacent said back edge, a second of said bracket members being positioned adjacent said front edge, a third of said bracket members being positioned between said first and second bracket members nearer said first bracket member.

* * * * *